US006601968B2

(12) United States Patent
Voacolo

(10) Patent No.: US 6,601,968 B2
(45) Date of Patent: Aug. 5, 2003

(54) FREESTANDING MAILBOX WITH DAMAGE RESISTANT ILLUMINATION

(76) Inventor: Jeff Voacolo, 250 Cypress La., Trenton, NJ (US) 08619

( * ) Notice: Subject to any disclaimer, the term of this patent is extended or adjusted under 35 U.S.C. 154(b) by 0 days.

(21) Appl. No.: 09/939,880

(22) Filed: Aug. 27, 2001

(65) Prior Publication Data

US 2002/0109985 A1 Aug. 15, 2002

Related U.S. Application Data

(60) Provisional application No. 60/268,325, filed on Feb. 13, 2001.

(51) Int. Cl.[7] ..... F21S 8/08
(52) U.S. Cl. ..... 362/154; 362/431; 232/17
(58) Field of Search ..... 362/154, 155, 362/156, 431, 576; 232/13, 17, 39, 34, 38; 40/566

(56) References Cited

U.S. PATENT DOCUMENTS 1,842,597 A * 1/1932 Foti ..... 362/155
2,452,667 A 11/1948 Lambert
4,646,209 A 2/1987 Jansen
4,648,012 A 3/1987 Pittman, II
5,143,285 A * 9/1992 Wise ..... 362/154
5,460,325 A 10/1995 Surman
5,522,540 A 6/1996 Surman
5,649,378 A * 7/1997 Roesser, Jr. et al. ..... 40/559
5,813,749 A 9/1998 Sheldon
5,975,713 A 11/1999 Brothers
6,017,131 A * 1/2000 Goins ..... 362/249
6,033,084 A 3/2000 Burke

* cited by examiner

*Primary Examiner*—Sandra O'Shea
*Assistant Examiner*—Bao Truong
(74) *Attorney, Agent, or Firm*—Mathews, Collins, Shepherd and McKay

(57) ABSTRACT

A freestanding mailbox is illuminated through the structural support post by an internal light source. A support element having an at least partially translucent section is coupled to a mailbox head. An illumination source is optically coupled to the support element, wherein the at least partially translucent section of the support element is illuminated by the illumination source. As the illumination source is optically coupled to the support element, the support element and/or mailbox head may be replaced if damaged without having to replace the illumination source.

20 Claims, 5 Drawing Sheets

FREESTANDING MAILBOX WITH DAMAGE RESISTANT ILLUMINATION

CROSS REFERENCES TO RELATED APPLICATIONS

This application claims the benefit of U.S. Provisional Patent Application Ser. No. 60/268,325 filed on Feb. 13, 2001.

FIELD OF THE INVENTION

This invention relates a mailbox structure and more particularly to a free standing mailbox.

BACKGROUND OF THE INVENTION

Mailboxes generally are of two types, the urban mailbox and the rural mailbox. Urban mailboxes are those types of mailboxes which are physically attached to the dwelling units they service. Rural mailboxes are those types of mailboxes, which are free standing, essentially physically separate from the dwelling units they service. Rural mailboxes usually have the shape of oblong boxes with rounded tops and are mounted on posts very close to the side of the roads in front of the houses that they service. The proximity of rural mailboxes to the edge of the road allows the mail carrier to deposit mail in the rural mailbox without getting out of his mail carrier vehicle since the door to such typical rural mailboxes faces the roadside. The rural freestanding mailboxes serve multiple purposes, in particular they are used to deposit mail in as well as to identify the property location associated with the mailbox. However, the very proximity of the rural mailbox to the edge of the road, out of necessity, makes the rural mailbox highly susceptible to damage from passing vehicles, objects tossed up from the road by passing vehicles, such as stones, road salt, snow and ice, and vandalism by the occupants of a passing vehicle. Illumination systems have been associated with rural mailboxes, which include devices, which illuminate the interior of the oblong box, are attached to the exterior of the oblong box and/or post, and detached illumination such as floodlights.

There is a need for a freestanding mailbox system, which can provide illumination to enhance visibility while being resistant to vandalism and accidental damage.

SUMMARY OF THE INVENTION

In one aspect, the present invention is a freestanding mailbox illuminated through the structural support post with an internal light source.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

The present invention is a freestanding mailbox illuminated through the structural support post with an internal light source, which provides illumination to enhance visibility while being resistant to vandalism and accidental damage. The soft light glow radiating from the interior of the structure serves as a property marker. Color of the illumination can be rapidly and remotely changed. This change in color can be used to signal a party trying to locate the property, such as delivery personnel or emergency services. A panic/emergency mode will cause the mailbox structure to blink and/or alternate colors. Thus reducing the time of response for emergency services such as fire, police and ambulance. Blinking is accomplished by flashing the illumination source on and off. Color of illumination may be changed by switching selected illumination sources or through the use of a movable color filter.

Additionally an integral intercom can be used to communicate with delivery and emergency services as well as with neighbors passing by. While the light source is particularly well suited to be located at the bottom of the support, it is equally well suited to be positioned within the support member. Reflector lenses located at the bottom and the top of the support element result in directing the light from the source up into the support element and into the mailbox head, for a visual effect of a glowing mailbox.

Figure 1:
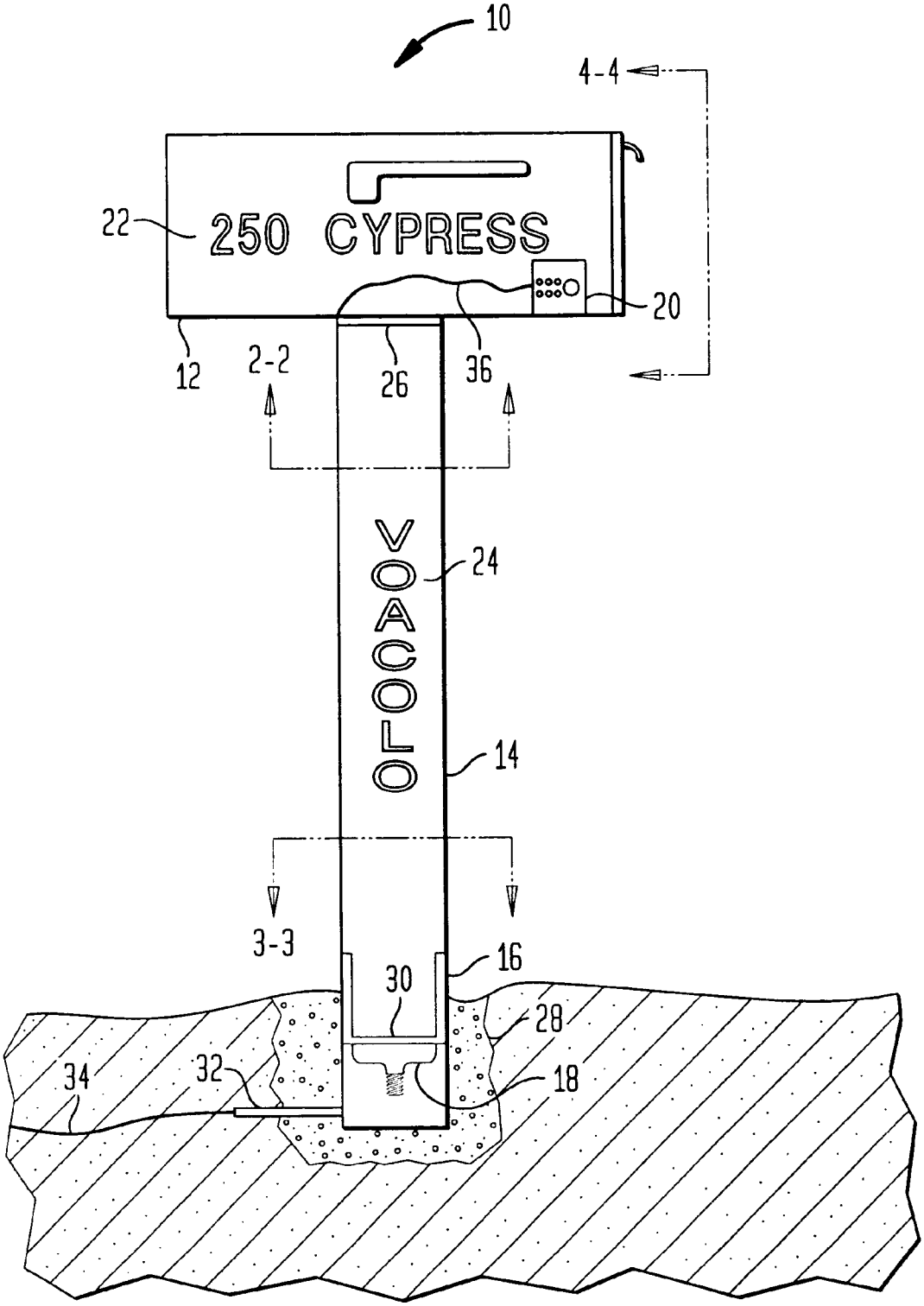
FIG. 1 is a side view of the mailbox with damage resistant illumination.

Referring to FIG. 1 there is shown a side view of the freestanding mailbox with damage resistant illumination. The freestanding mailbox with damage resistant illumination 10 is comprised of a mailbox head 12, mailbox support element 14 and support mount 16. Typically, when a freestanding mailbox is damaged by accident or vandalism, the mailbox head 12 is damaged or even sheared off of the mailbox support element 14. If the mailbox support element 14 is directly hit by a vehicle it may become severely damaged or even sheared off near the ground. The freestanding mailbox with damage resistant illumination 10 is capable of being completely sheared off near the ground, while maintaining the physical and electrical integrity of an illumination source 18 located within the support mount 16. In this particular embodiment of the freestanding mailbox with damage resistant illumination 10, the mailbox head 12 and the mailbox support element 14 contain no electrical wiring or assemblies. This enables the installation and assembly of the support mount 16 to be done by a qualified licensed electrical contractor, while the actual installation or subsequent replacement of mailbox head 12 and/or mailbox support element 14 can be done by someone other than a licensed electrical contractor.

The mailbox head 12 is a typical shape as regulated by the United States Postal Service. The mailbox head 12 contains an optional intercom module 20, which may be wireless or wired and a number/name area 22 where an identification sheet or letters may be inserted or applied. The mailbox head 12 is made from a translucent material, which may be colored or white. The translucent material may be mixed with darker or even opaque areas of material to create patterns. The material directly behind the number/name area 22 may be more transparent than other areas, thus drawing additional attention to the number/name area 22.

The mailbox support element 14, while shown with a circular cross section, is equally well suited for used with a rectangular, square, oval, triangle, hexagon, pentagon or other shape. The mailbox support element 14 contains a number/name area 24 where an identification sheet or letters may be inserted or applied. The mailbox support element 14 is made from a translucent material, which may be colored or white. The translucent material may be mixed with darker or even opaque areas of material to create patterns. The material directly behind the number/name area 24 may be more transparent than other areas, thus drawing additional attention to the number/name area 24. A plastic magnifying reflector lens 26 is located at the intersection of the mailbox support element 14 and the mailbox head 12.

The support mount 16 is secured, such as by concrete 28. Alternatively the support mount 16 may be secured by compressed earth, attachment to curbing, or my other suitable methods. The illumination source 18 located within the support mount 16 has a lens 30 suitable for focusing the light upwards into the mailbox support element 14. A conduit 32 such as ½" PVC tubing is coupled to the support mount 16. An electrical cable 34, such as a 3 wire 12-gauge multiconductor cable suitable for direct burial is coupled from the power source (not shown) through the conduit 32 to the illumination source 18. While the present invention is particularly well suited for standard 120V AC service, it may also be used with low voltage DC service, although at reduced illumination. If the intercom 20 is hardwired, the intercom cable 36 may be feed through the mailbox support element 14 into the support mount 16 and through the conduit 32.

Figure 2:
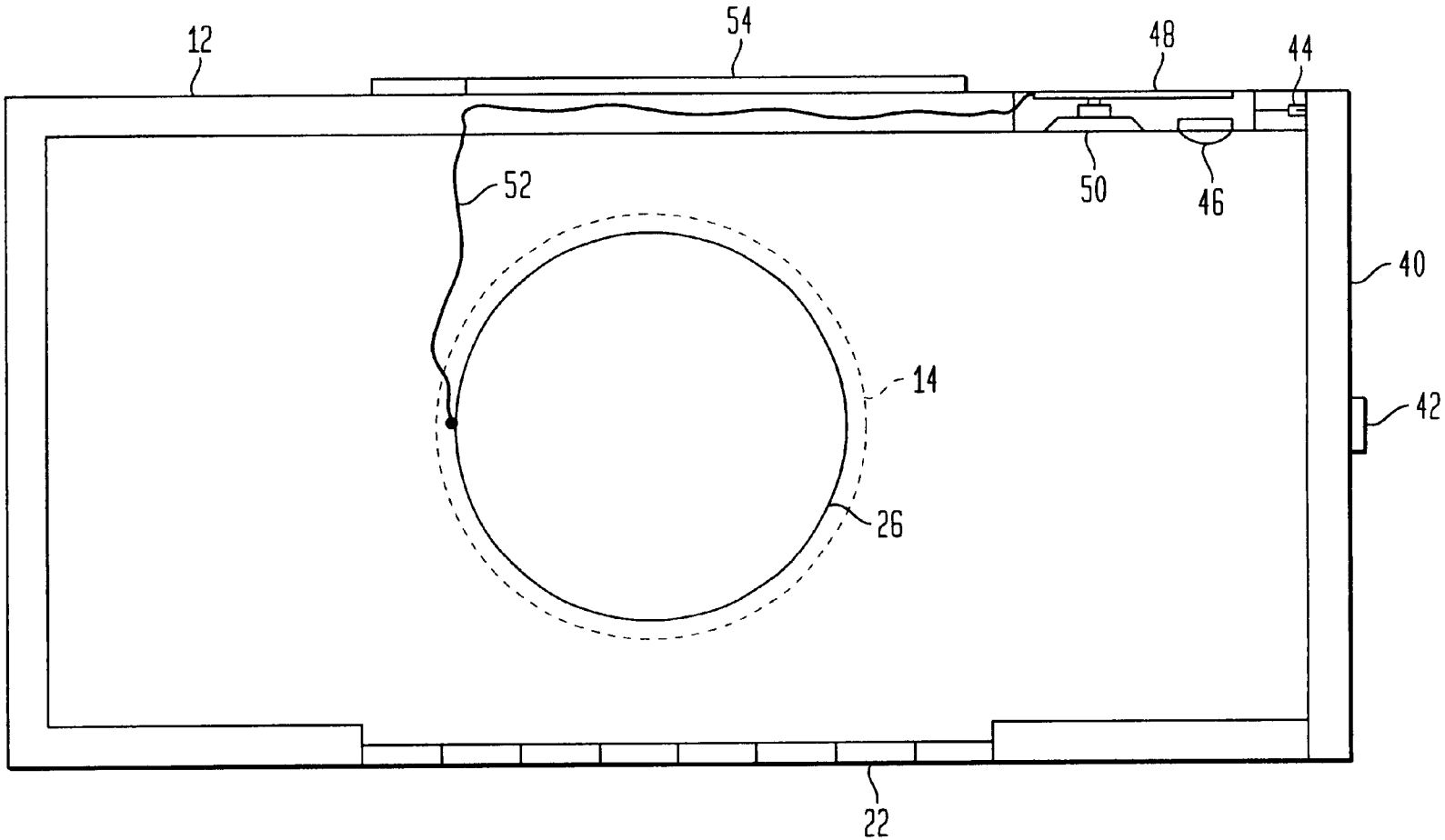
FIG. 2 is an upper cross sectional view through axis 2—2.

Referring to FIG. 2 there is shown a cross sectional view of the freestanding mailbox with damage resistant illumination through axis 2—2. Similar elements in FIG. 1 are given the same numbers. The mailbox head 12 is comprised of a hinged mailbox door 40, a door handle 42, a door sensor switch 44, doorbell 46, a control circuit 48, a two may speaker or transducer 50, shielded cable 52, and mailbox flag 54. The cross section of a round mailbox support element 14 and plastic magnifying reflector lens 26 are shown. The number/name area 22 where an identification sheet or letters may be inserted or applied is integral to the mailbox head 12.

The door sensor switch 44 alerts the resident that mail is in the box, by use of the intercom, changing color of the illumination, or other suitable notification/signaling device. The control circuit 48, may be a printed circuit board, ASIC (Application Specific Integrated Circuit) or other suitable circuit, for controlling the door switch, speaker, doorbell, and other necessary functions.

Figure 3:
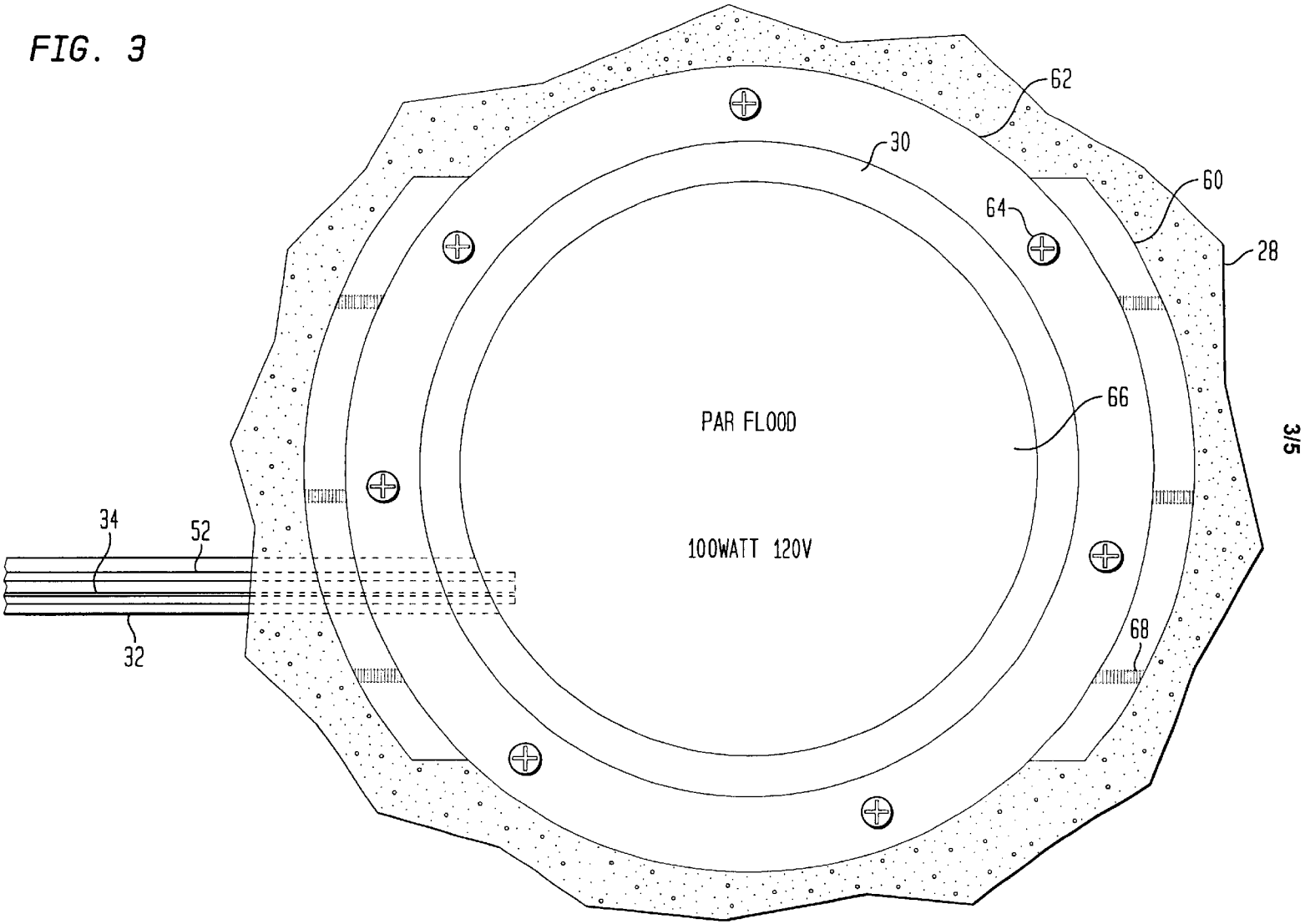
FIG. 3 is a lower cross sectional view through axis 3—3.

Referring to FIG. 3 there is shown a cross sectional view of the freestanding mailbox with damage resistant illumination through axis 3—3. There is shown a detail of the upper part of the illumination source 18. Similar elements in FIGS. 1 and 2 are given the same numbers. There can be seen wiring supports 60 on the illumination source 18 for mounting. The body 62 of the illumination source 18 is made of a dielectric plastic material. Phillip head screws 64 secure a cover guard over the glass lens 30. A 100-watt par flood lamp 66 can be clear, green, yellow, red, blue, or other colors. Alternatively, several halogen lamp sources with different color filters may be used. Tapped holes 68 are shown to screw the base into the support mount 16.

Figure 4:
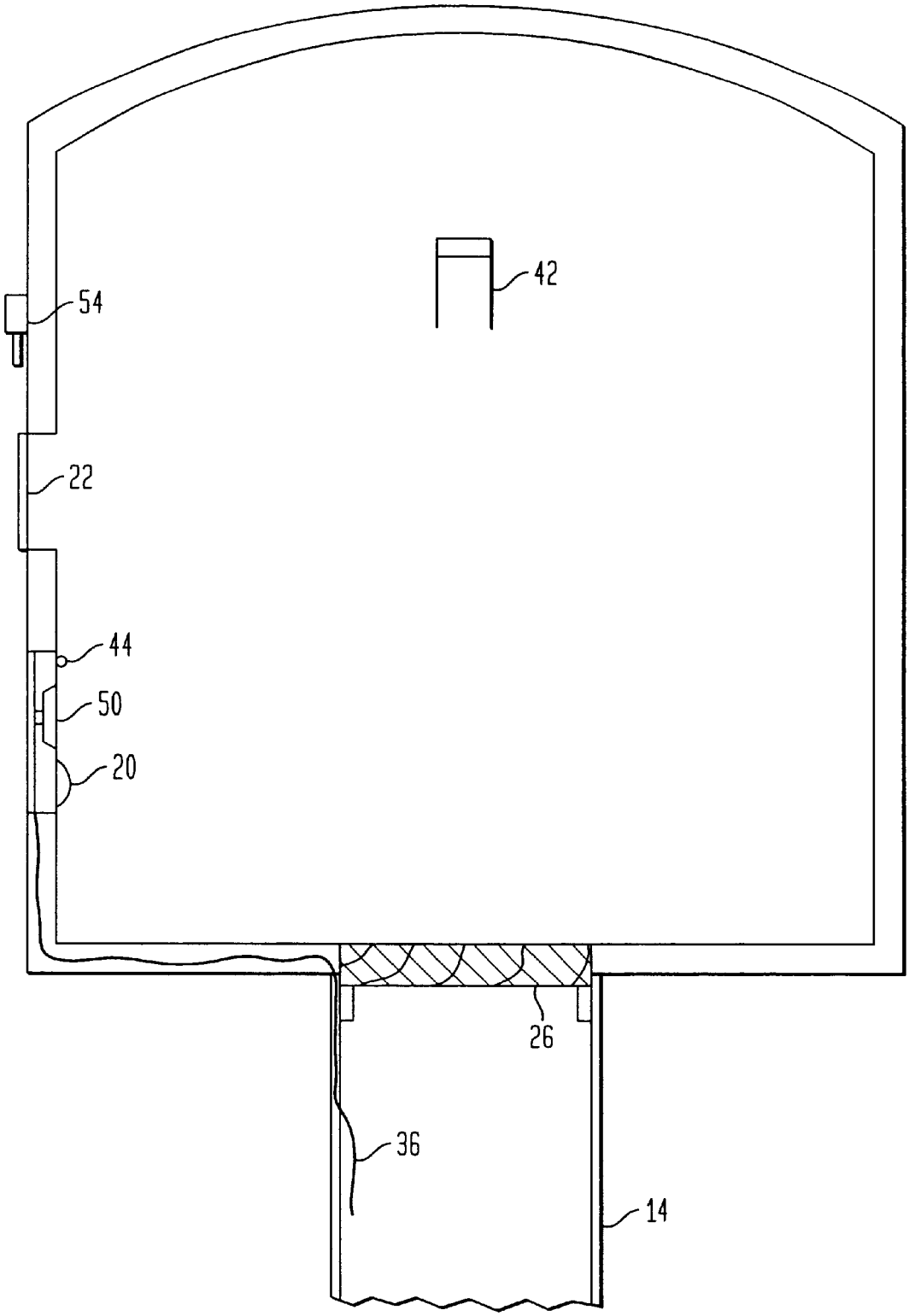
FIG. 4 is a cross sectional view through axis 4—4.
Figure 5:
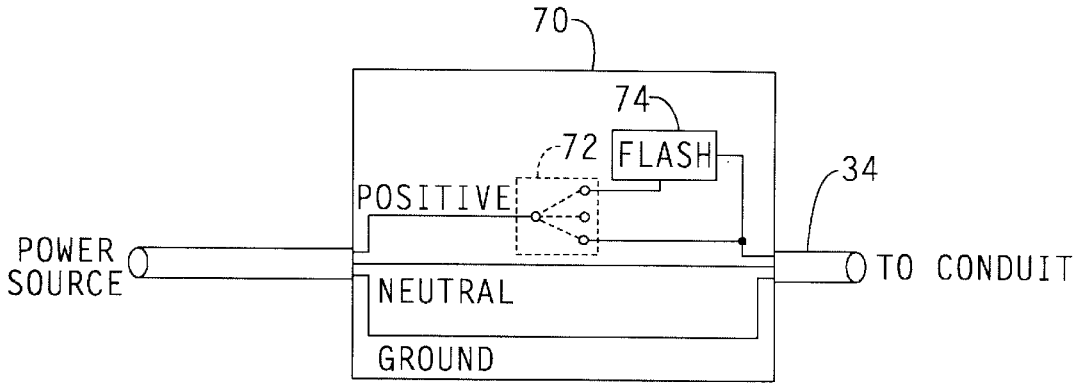
FIG. 5 is a schematic diagram of the switching control for selective flashing illumination.
Figure 6:
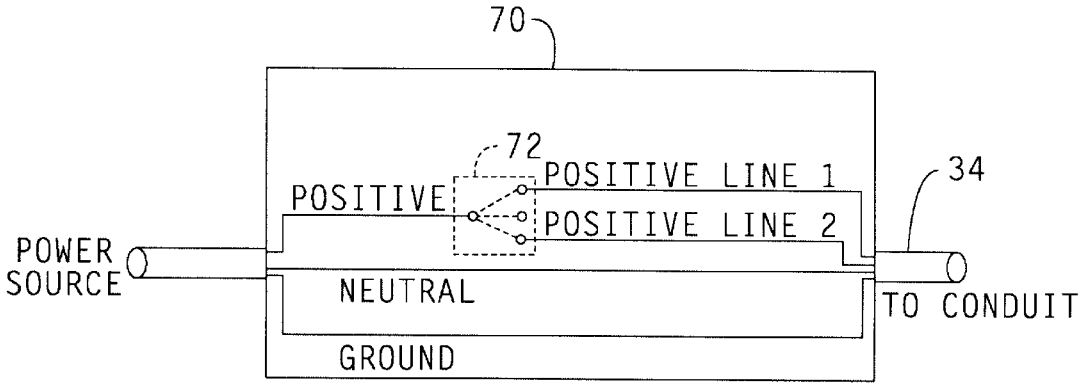
FIG. 6 is a schematic diagram of the switching control for multicolor illumination; and, FIG. 7 is a schematic diagram of a multicolor illumination source.
Figure 7:
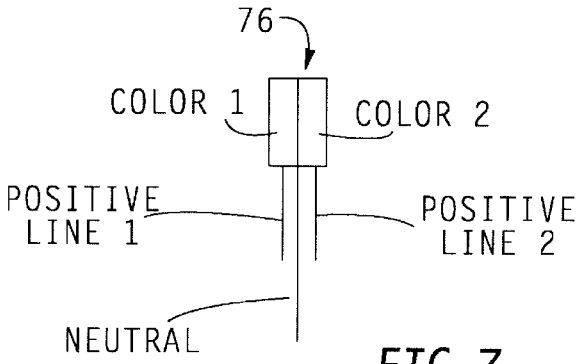

Referring to FIG. 4 there is shown a partial cross sectional view of the freestanding mailbox with damage resistant illumination through axis 4—4. Referring to FIG. 5 there is shown a schematic diagram of the switching control 70 for selective flashing illumination. In this illustrative embodiment, the positive (hot) power lead is connected to a three position switch 72. The three position switch 72 has a first output position connected to the input of a flasher module 74, a second output position left open providing an off position, and a third output position connected to the positive (hot) feed to the freestanding mailbox with damage resistant illumination and the output of the flasher module 74. Referring to FIG. 6 there is shown a schematic diagram of the switching control for multicolor illumination. In this illustrative embodiment, the positive (hot) power lead is connected to a three position switch 72. The three position switch 72 has a first output position connected to a positive (hot) line 1 feed to the freestanding mailbox with damage resistant illumination, a second output position left open providing an off position, and a third output position connected to the positive (hot) line 2 feed to the freestanding mailbox with damage resistant illumination. FIG. 7 is a schematic diagram of a multicolor illumination source producing a first color when the positive (hot) line 1 is powered and a second color when the positive (hot) line 2 is powered. Similar elements in FIGS. 1, 2, 3, 4, 5, 6 and 7 are given the same numbers.

In view of the foregoing description, numerous modifications and alternative embodiments of the invention will be apparent to those skilled in the art. The mailbox support element or the mailbox head may be partly opaque. Accordingly, this description is to be construed as illustrative only and is for the purpose of teaching those skilled in the art the best mode of carrying out the invention. Details of the structure may be varied substantially without departing from the spirit of the invention, and the exclusive use of all modifications, which come within the scope of the appended claim, is reserved.

What is claimed is:

1. A freestanding illuminated mailbox comprising:

a mailbox head;

a support element having an at least partially translucent section; said support element coupled to said mailbox head; and, a base having an illumination source; said base coupled to said support element;

wherein said at least partially translucent section of said support element is illuminated by said illumination source in said base through said support element such that said support element and said mailbox head can be removed and replaced independently of said illumination source.

2. The freestanding illuminated mailbox as recited in claim 1, wherein the mailbox head has an at least partially translucent section, said at least partially translucent section illuminated by said illumination source.

3. The freestanding illuminated mailbox as recited in claim 1 further comprising said illumination source mounted to said base.

4. The freestanding illuminated mailbox as recited in claim 1 further comprising an indicia coupled to said at least partially translucent section of said support element.

5. The freestanding illuminated mailbox as recited in claim 2 further comprising an indicia coupled to said at least partially translucent section of said mailbox head.

6. The freestanding illuminated mailbox as recited in claim 1 further comprising means for said illumination source to selectively be pulsed.

7. The freestanding illuminated mailbox as recited in claim 1 wherein said illumination source further comprises a switchable illumination source for selecting different colors.

8. A freestanding illuminated mailbox comprising:

a mailbox head having an at least partially translucent section;

a support element; said support element coupled to said mailbox head; and, a base having an illumination source; said base coupled to said support element;

wherein said at least partially translucent section of said mailbox head is illuminated by said illumination source in said base through said support element such that said support element and said mailbox head can be removed and replaced independently of said illumination source.

9. The freestanding illuminated mailbox as recited in claim 8, wherein the support element has an at least partially translucent section, said at least partially translucent section illuminated by said illumination source.

10. The freestanding illuminated mailbox as recited in claim 8 further comprising said illumination source mounted to said base.

11. The freestanding illuminated mailbox as recited in claim 9 further comprising an indicia coupled to said at least partially translucent section of said support element.

12. The freestanding illuminated mailbox as recited in claim 8 further comprising an indicia coupled to said at least partially translucent section of said mailbox head.

13. The freestanding illuminated mailbox as recited in claim 8 further comprising means for said illumination source to selectively be pulsed.

14. The freestanding illuminated mailbox as recited in claim 8 wherein said illumination source further comprises a switchable illumination source for selecting different colors.

15. A system for illuminating a freestanding mailbox having a mailbox head, the system comprising:

a support element having an at least partially translucent section; said support element coupled to said mailbox head; and, a base having an illumination source; said base coupled to said support element;

wherein said at least partially translucent section of said support element is illuminated by said illumination source in said base such that said support element can be removed and replaced independently of said illumination source.

16. The system for illuminating a freestanding mailbox having a mailbox head as recited in claim 15 further comprising said illumination source mounted to said base.

17. The system for illuminating a freestanding mailbox having a mailbox head as recited in claim 15 further comprising an indicia coupled to said at least partially translucent section of said support element.

18. The system for illuminating a freestanding mailbox having a mailbox head as recited in claim 15 further comprising means for said illumination source to selectively be pulsed.

19. The system for illuminating a freestanding mailbox having a mailbox head as recited in claim 15 wherein said illumination source further comprises a switchable illumination source for selecting different colors.

20. The system for illuminating a freestanding mailbox having a mailbox head as recited in claim 15 further comprising a circuit for remotely controlling said illumination source.

* * * * *